US005296684A

United States Patent [19]

Essig et al.

[11] Patent Number: 5,296,684

[45] Date of Patent: Mar. 22, 1994

[54] DEVICE FOR DETECTING A COOKING VESSEL POSITIONED IN A HEATING ZONE OF A COOKER OR HEATER

[75] Inventors: Willi Essig, Boeblingen; Ivo Russ, Oberderdingen, both of Fed. Rep. of Germany

[73] Assignee: E.G.O. Elektro-Gerate Blanc u. Fischer, Fed. Rep. of Germany

[21] Appl. No.: 650,489

[22] Filed: Feb. 5, 1991

[30] Foreign Application Priority Data

Feb. 10, 1990 [DE] Fed. Rep. of Germany ..... 4004129

[51] Int. Cl.[5] ..... H05B 1/02

[52] U.S. Cl. ..... 219/518; 219/506; 219/453; 219/452; 219/491; 219/497; 307/117

[58] Field of Search ..... 219/506, 516, 518, 464, 219/465, 453, 448, 451, 452, 450, 449; 200/600; 307/116, 117

[56] References Cited

U.S. PATENT DOCUMENTS

| | | | |
|---|---|---|---|
| 4,013,859 | 3/1977 | Peters | 219/10.49 |
| 4,016,392 | 4/1977 | Kobayashi | 219/10.49 |
| 4,308,443 | 12/1981 | Tucker | 219/506 |
| 4,334,135 | 6/1982 | Smith | 219/518 |

FOREIGN PATENT DOCUMENTS

| | | |
|---|---|---|
| 238331 | 2/1965 | Austria . |
| 805538 | 5/1951 | Fed. Rep. of Germany . |
| 7132382 | 4/1972 | Fed. Rep. of Germany . |
| 2831858 | 2/1980 | Fed. Rep. of Germany . |
| 3002623 | 7/1981 | Fed. Rep. of Germany . |
| 3117205 | 12/1982 | Fed. Rep. of Germany . |
| 3209260 | 9/1983 | Fed. Rep. of Germany . |
| 8312896 | 9/1983 | Fed. Rep. of Germany . |
| 3327622 | 2/1985 | Fed. Rep. of Germany . |
| 3533997 | 3/1987 | Fed. Rep. of Germany . |
| 3619762 | 12/1987 | Fed. Rep. of Germany . |
| 3711589 | 10/1988 | Fed. Rep. of Germany . |
| 3733108 | 2/1989 | Fed. Rep. of Germany . |
| 3737712 | 5/1989 | Fed. Rep. of Germany . |
| 3804170 | 8/1989 | Fed. Rep. of Germany . |
| 1340411 | 11/1963 | France . |

*Primary Examiner*—Mark H. Paschall
*Attorney, Agent, or Firm*—Quarles & Brady

[57] ABSTRACT

The device comprises a sensor supplying a sensor signal which varies as a result of the placement of a cooking vessel in a heating zone of a heating appliance. The device includes evaluating circuit which, as a function of the sensor signal, supplies an output signal. The evaluating circuit produces the output signal as a function of the rate of change of the sensor signal to indicate the presence or absence of cookware in the heating zone of the heating appliance.

16 Claims, 2 Drawing Sheets

DEVICE FOR DETECTING A COOKING VESSEL POSITIONED IN A HEATING ZONE OF A COOKER OR HEATER

DESCRIPTION OF PRIOR ART

Attempts have already been made to create pot detection systems, which only connect in a cooker when a pot is present in the heating zone. Systems are known using optical sensors and in part with brightness comparison (DE-A 35 33 997 and 33 27 622) and with inductive sensors (DE-A 37 11 589 and 37 33 108). In all these systems the arrangement of the sensor in the heated zone was problematical. Sensors which withstand high temperatures are usually too insensitive in order to be able to separate useful and spurious or unwanted signals, particularly because the pots have a widely differing behaviour in the sensor field.

OBJECT OF THE INVENTION

Object of the invention is to provide a device, in which the arrangement of the sensor in the heating zone causes no problems and which permits a clear detection of a pot present under the most varied operating conditions.

SUMMARY OF THE INVENTION

The dependence of the detection on the rate of signal change makes it unnecessary to set a specific absolute value for the switching point, so that it is possible to take into account varying basic requirements, e.g. sensor characteristics modified by the thermal influence. The dependence on the rate of change makes it possible to select the response speed of the pot detection higher than the rate of change to the basic values. This device makes it possible to detect pots, which cause such small sensor signal changes, that they are no larger or even smaller than the change to the sensor characteristics. However, as these characteristics change much more slowly than the pot to be detected, a clear distinction is possible.

This offers a broad range of use for sensors, which could not be used up to now. Inductive sensors could only be used with poor results, because they are shielded against the temperature and must therefore be too remote from the actual cooking point. According to the invention they can be positioned directly at the heating point, e.g. on the edge or in the centre of the heating zone and in particular just below the cooking surface and closer to the latter than e.g. radiant heating elements. A particularly advantageous material for an inductive sensor is a thermally stable material, which could not be used for such purposes hitherto, namely an electrically insulating, oxidized heating conductor material, e.g. a chromium-nickel alloy of type Ni Cr 7030. Although this material is known as a heat conductor, it was considered unusable for induction coils due to its high resistance value and in particular as a ferromagnetic core could not be used for temperature reasons. In the vicinity of the induction coil temperatures up to 1300K (approximately 1000° C.) can occur, whilst conventional coil materials can only withstand a fraction of such temperatures.

According to the invention the evaluating means can operate in analog manner and determine the rate of change by a differentiation of the output sensor signal. However, with particular advantage the evaluating means operate digitally, the starting point being a comparison of the pulses of a sensor resonating circuit frequency counted over a specific gating time and a reference number, which is kept away from the sensor-dependent pulse count or number by a specific threshold value. In a predetermined time sequence the reference number is adapted to the actual value of the sensor frequency-dependent number, so that in all operating states the threshold value has a level which is of a specific nature and is optionally also dependent on the absolute value of the sensor signal. The threshold value sign is modified as a function of the detection (pot present/absent). If the difference between the sensor-dependent value and the reference value becomes too large the readjustment to the threshold value, which should fundamentally take place slowly to be able to evaluate low values, could be sped up by shortening the readjustment time. This can be achieved by a readjustment speed directly dependent on the magnitude of the particular difference value. When working digitally a simple, but still good quality adaptation can be obtained in that following initial readjustment with a constant adaptation speed, the latter takes place in jumps if the adaptation has not been completed by a predetermined time.

It is particularly advantageous to use a microcontroller, i.e. a programmable component operating digitally in the manner of a computer and such as is frequently used in controls. It could simultaneously contain the functions of a settable power control unit, a temperature dependent regulating unit and/or further control functions, such as e.g. for a cooking surge, for temperature limitation, etc., so that normally, apart from control sensors, it is only necessary to have a code generator for the manual setting and a power switching component (relay, triac, etc.), in order to bring about the complete cooker control.

The device can have different sensor systems, such as capacitive, optical or similar sensors. In the case of certain sensor types, e.g. inductive sensors, certain cooking vessel materials are not detected. Therefore the device should have a bridging or disconnecting device, which permits a cooker operation independent of pot detection. It can be time-controlled, so that after a certain time it can be switched back to automatic pot detection.

In the case of a device processing the signals in analog manner, the aforementioned operating sequence could also be used. Then, in place of pulse counting and subtraction from these values, use is made of a difference (beat) between the sensor frequency and a correspondingly readjusted reference frequency. The device can also be in the form of a user-specific integrated circuit (USIC).

Apart from easy operation, the invention leads to further advantages, particularly increased safety, because it is ensured that a cooking point is not further operated under no-load conditions after removing the cooking utensil. The inductive construction dependent on a ferromagnetic material is in the cooking vessel has the additional safety advantage that it e.g. does not respond on placing a plastic container on the cooker and as would be possible with optical devices.

BRIEF DESCRIPTION OF THE DRAWINGS

These and further features of preferred developments of the invention can be gathered from the claims, description and drawings and the individual features, either alone or in the form of subcombinations, can be realized in an embodiment of the invention and in other fields and can represent advantageous, independently protectable constructions for which protection is hereby claimed. Embodiments of the invention are described hereinafter relative to the drawings, wherein show:

DETAILED DESCRIPTION OF PREFERRED EMBODIMENTS

Figure 1:
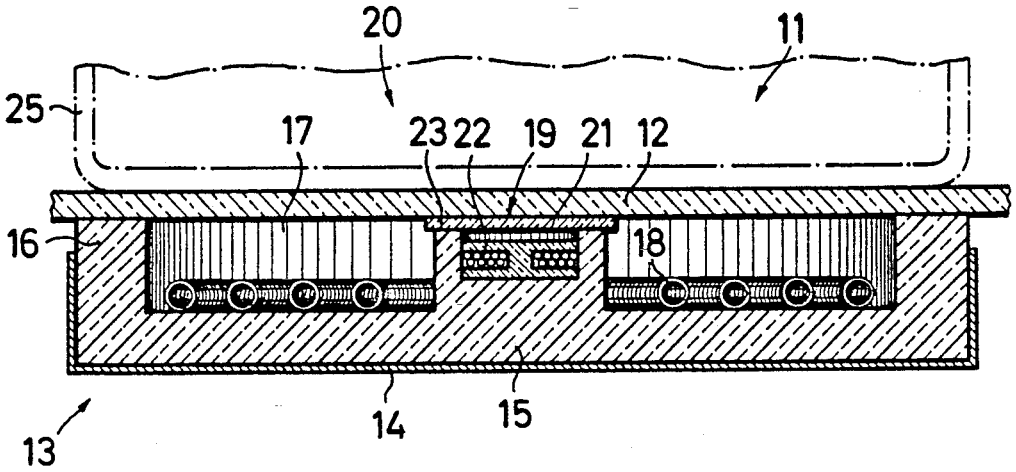
FIGS. 1 and 2 in each case a diagrammatic partial section through a cooking utensil with a glass ceramic plate and a radiant heater.

FIG. 1 shows part of a cooker 11 with radiant heaters 13 located below a glass ceramic plate. In a sheet metal support tray 14 it contains a heat resistant insulation 15 with an all-round edge 16 supported on the glass ceramic plate 12 and a circular recess 17, on whose bottom radial heating resistors 18 are wound spirally around a central zone 19, e.g. in the form of a heating coil. Several radiant heaters 13 are resiliently pressed onto the underside of a glass ceramic plate 12 and form individual heating zones, whilst also being suitable for warming or other purposes.

The central zone 19 is formed by an upwardly projecting portion of the insulation 15. In it is provided a recess 21, in which is located a sensor coil 22. The recess is closed at the top by a disk 23 of a heat resistant insulating material which is stronger than the insulating material 15 and which is supported on the underside of the glass ceramic plate 12. Therefore the coil 22 is in an area protected from the direct heat radiation from the heaters. The electrically insulating disk 23 ensures that there is no contact with live parts, because under operating temperatures the glass ceramic becomes conductive. It also protects the edges of the central zone from damage.

Thus, the coil is located directly below the glass ceramic plate and closer to the latter than the heating resistors 18 and also is located at a central point.

Figure 2:
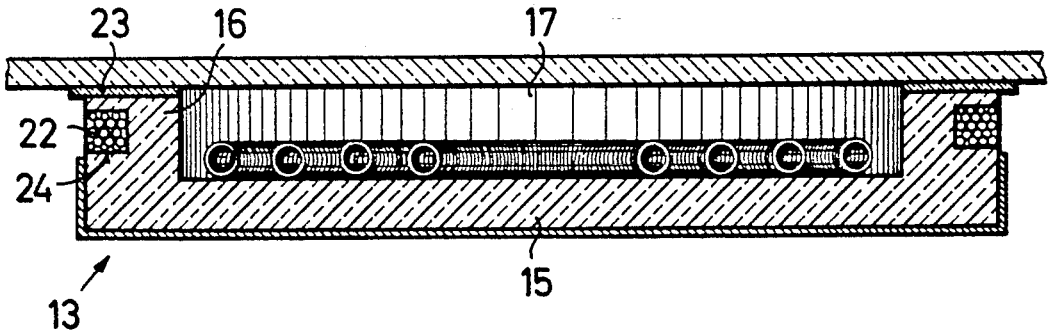

FIG. 2 differs from FIG. 1 only in that its insulation 15 for the radiant heater 13 has a tray or pan shape without a raised central zone. The sensor coil 22 extends entirely around the radiant heater and is located in an all-round groove 24 provided from the outside in the upper part of the insulation edge 16. Between the glass ceramic plate 12 and the edge 16 is inserted a circular disk 23, which has a mechanical and electrical protective function. The groove could also be an angular marginal recess, i.e. without interposing part of the insulator 15 between the coil and the disk.

Here again the coil is protected against the direct effects of the radiant heating, but significant temperatures still occur there. Therefore the coil is made from a material which, including its insulation, is able to resist temperatures above 1300K (approximately 1000° C.). It is preferably a chromium-nickel alloy of type Ni Cr 7030. It is electrically insulated by oxidizing its outer surface. However, this material has a very high electrical resistance. Particularly in a construction according to FIG. 2, it may only have a few turns. Therefore the coil quality is low due to the lack of a ferromagnetic core. However, this material permits use directly in the vicinity of the heating zone and optionally even nearer to the heating resistors or between the latter and the glass ceramic plate. The coil 22 is the sensor of a device for detecting a cooking vessel 25 positioned in the heating zone, said term referring to roasting, heating or similar vessels. The sensor responds to such cooking vessels, provided that they are made from or contain a material which modifies its inductance (ferromagnetic material). The pot detection system will be explained relative to FIG. 3. In the case of a change in the induction of its environment resulting from the positioning of a cooking vessel 25, the sensor coil 22 produces an output signal in the form of an inductance change. It is part of a resonating circuit, whose other parts, e.g. a capacitor, are contained in a signal input element 26. Subsequently in a signal converter 27 the signal is converted into a square-wave signal, i.e. a square-wave frequency is produced from the sinusoidal oscillating or resonating frequency which is better suited for digital processing. In the following frequency measuring device 28 over a specific gating time predetermined by a timer 29, the number of pulses of the squarewave signal and therefore a number representing the resonating frequency is determined and stored. This sensor frequency-dependent pulse number or count is passed to a subtractor 30, where it is compared with a corresponding reference number obtained from a reference number memory and is formed there in the manner to be described hereinafter. Once every gating time a signal corresponding to the difference formed is supplied to a combinational logic 32, including the sign of the difference. The combinational logic 32 also contains a memory for a desired interval or threshold value and on dropping below this an output signal is supplied to switching means 33, optionally via a subsequently explained regulating or control device 34. As a function of the existing operating state (cooking utensil present/absent or cooker on/off) a number corresponding to the threshold value can be added to or subtracted from the difference, so that at the zero crossing a corresponding enable signal is provided. This takes place with the rhythm of the gating time, which can be fractions of seconds.

The comparison number stored in the memory 31 is adapted or compensated to the actual value, i.e. the number corresponding to the sensor frequency. The aim is to obtain a specific desired interval or difference. For this purpose on changing the actual value and therefore the differential value via an adapting device 35 a specific amount is added or subtracted to the comparison or reference number in the memory 31 for each cycle (gating time interval), this being dependent on the plus or minus sign in the memory of the combinational logic 32. Therefore the reference number is adapted, i.e. compensated towards the actual value until the difference desired values is reached. An identical response threshold is always reached independently of the absolute value of the signal present.

If this adaptation, which is slower than the corresponding actual value change to be initiated by a circuit, proves to be too slow in order to have achieved a difference desired value in a predetermined time, which is determined in a timer 36, then by means of a reference jump device 37 the reference value is raised in a jump to the desired difference value. A resetting device 38 resets the timer 36 to the start if the desired difference is reached before the time has expired.

Figure 3:
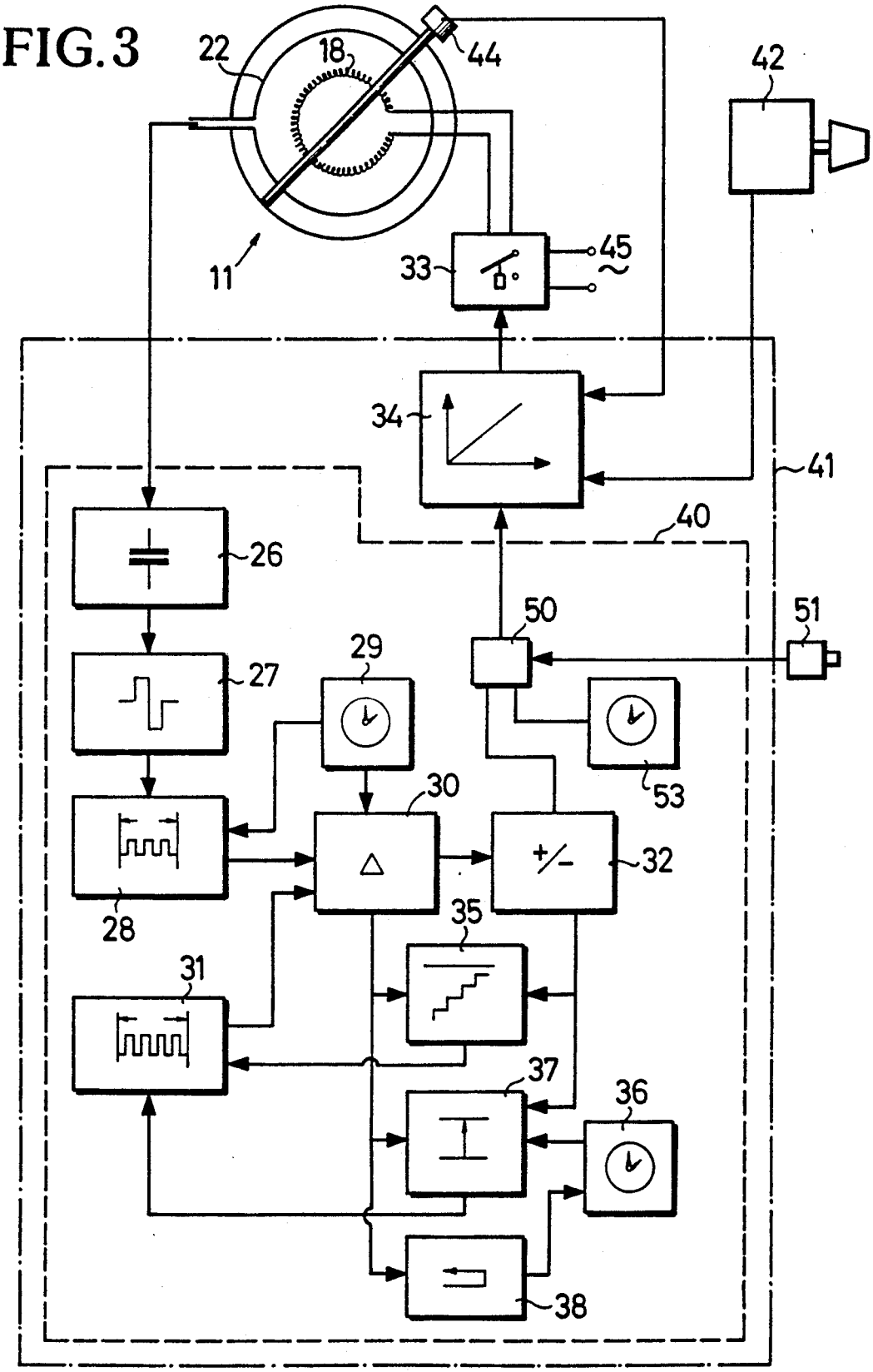
FIG. 3 a block circuit diagram of a pot detection device, the individual blocks being provided with explanatory functional symbols.

With the exception of the switching means 33 and the regulating or control unit 34, the described circuit means belong to the evaluating means 40, as symbolized by the broken line frames in FIG. 3, most of them operating digitally in the present embodiment. Including the regulating or control unit 34, they can form part of a microcontroller 41 or microcomputer. The latter does not physically contain the devices and elements described relative to FIG. 3 and are instead replaced by corresponding programming in order to perform the functions described. This also applies relative to the function of the regulating or control unit 34, which in addition to the switching on/off function, also performs functions such as power setting, temperature, monitoring, etc. It also receives an output signal from the evaluating means 40, as well as optionally signals from a code generator 42, which can e.g. be a binary generator operated by a setting button and/or from a temperature measuring and/or switching device 44. On the heavy current side the switching means 43 switch the voltage of the domestic mains 45 to the heating resistors 18 and can contain a mechanical relay or corresponding electronic components.

The device functions according to the following process. If the cooker is ready to operate, but its heating system is not switched on, then the resonating circuit containing the sensor coil 22 is in operation. It produces a specific frequency, so that the frequency measuring and storage means establishes a specific pulse count during the gating time. The associated reference count or number from the reference count memory 31 is spaced therefrom by a predetermined difference. If as a result of putting into place a cooking vessel the inductance of the resonating circuit operated with a relatively high frequency of e.g. 100 kHz to 1 mHz changes, there is also a change to the actual number or count, which is determined by the frequency measuring device during the gating time and is supplied to the subtractor 30. If this exceeds the threshold value, a zero crossing takes place in the combinational logic 32 and e.g. a positive output signal is produced which, via the regulating-/control unit 34 and the switching means 33, switches on the heating system 18.

By means of the adapting device 25, for each cycle there is now a stepwise, relatively slow adaptation of the reference value to the actual values. On e.g. using a very highly ferromagnetic pot, which had caused a considerable inductance change, then within a predetermined time set by the timer 36 the desired interval might not be reached, so that there would be a sudden adaptation by means of the jump device 37, by setting the reference value to the predetermined desired interval with respect to the actual value. Thus, after a relatively short time the evaluating device is again in a position to respond to lower inductance changes, e.g. after removing a highly ferromagnetic pot and replacing it by a less ferromagnetic pot.

As a result of thermal and other environmental influences, the inductance characteristics of the sensor coil 22 change significantly. In particular, the high temperature-resistant coil material has a very positive resistance characteristic leading to a significant drift of the inductance values without any spatial change to the pot/heating zone association. As these changes which are significant in absolute values take place in a time differing significantly from the putting into place or removal of a pot, the adaptation of the reference value via the adapting device 35 can easily follow said change and the threshold value interval can be reset without there being any initiation of the evaluating means. Therefore they only react to changes taking place more rapidly than the adaptation, so that, via the adaptation speed, it is also possible to predetermine the sensitivity of the device.

On removing a pot the same takes place, but in this case the subtraction has a different sign, so that also the combinational logic supplies and stores a correspondingly poled output signal. The adaptation direction is also dependent on this polarity.

The evaluating means also contain a temporary disconnection device 50, which is operated by the user, e.g. using a pushbutton 51. It enables the user to put the evaluating device out of operation for a time predetermined by a timer 53 with respect to its effect on the switching means 33, e.g. when wishing to cook with a glass ceramic utensil. The circuit diagram indicates that the output signal of the combinational logic 32 is suppressed. However, this disconnection means could also be realized in some other way, e.g. by disconnecting the entire evaluating means, by heavy current bridging of the switching means 33, etc. What is important is that after a specific time (timer 53), this disconnection of the pot detection used for bridging purposes is set aside again in order to return to automatic pot detection and therefore restore the advantageous function and safety action. The manual influencing can also take place by means of a conventional on/off switch, which is automatically reset after a given time. As the automatic pot detection not only leads to increased operational safety, but also to significant energy savings, it is not only suitable for domestic cookers, but in particular for commercial kitchens. It avoids the hitherto necessary all-day operation of the cookers and, in conjunction with a low capacity heating system, gives the same result without any time delay for the cook. An additional advantage is that less heat is evolved and consequently the working conditions for the kitchen staff are improved.

We claim:

1. Device for detecting a cooking vessel positioned in a heating zone of an appliance of a kind including cooking and heating appliances, the device comprising a sensor supplying a sensor signal, said sensor signal having a sensor signal characteristic dependent on the placement and removal of the cooking vessel in said heating zone; and evaluating means which, as a function of the sensor signal characteristic, supply an output signal for controlling the energization of the appliance, the evaluating means producing the output signal as a function of the rate of change of the sensor signal characteristic.

2. Device according to claim 1, wherein the sensor is an inductive sensor, which is located in or immediately adjacent to the heating zone.

3. Device according to claim 2, wherein the sensor is located on the underside of a plate forming the cooking surface of the appliance.

4. Device according to claim 1, wherein the sensor is located on a part of a heat resistant thermal insulator of a radiant heater.

5. Device according to claim 1, wherein the sensor is a coil without a ferromagnetic core and with only a few turns, which is made from a thermally stable material.

6. Device according to claim 5, wherein the coil is made from particularly an electrically insulating, oxidized heat conductor material of a group including a chromium-nickel alloy.

7. Device according to claim 1, wherein the sensor is part of a resonating circuit, whose resonating or oscillating frequency varies as a function of influence on the sensor inductance.

8. Device according to any of the preceding claims, wherein the evaluating means operate in analog manner and include sensor signal differentiation means.

9. Device according to claim 1 wherein the evaluating means operate in digital manner.

10. Device according to claim 7, wherein the evaluating means have comparison means for comparing a value dependent on frequency of the resonating circuit including the sensor with a reference value and adapting means for modifiying the reference value in the direction of the sensor-dependent value up to a predetermined threshold value.

11. Device according to claim 10, wherein the adapting means modify the reference value in time-dependent manner particularly with a rate of change dependent on the magnitude of the interval between the sensor-dependent value and the reference value.

12. Device according to claim 11, wherein the adapting means start with a constant rate of change and subsequently carry out a sudden adaptation when the threshold value interval is not reached in a predetermined unit of time.

13. Device according to claim 1, wherein switching means are provided, which modify the operating state of the cooker or heating appliance as a function of the output signal.

14. Device according to claim 1, further comprising operable disconnection means allowing an operation of the cooker or heating appliance independent of the detection of a cooking vessel for a limited time.

15. Device according to claim 9 or 10, wherein a regulating or control unit for operating states of the cooker or heating appliance is associated with the evaluating means.

16. Device according to claim 1, wherein the evaluating means are at least partly contained in a electronic module of a group comprising microcontrollers and integrated circuits being constructed for carrying out further control regulating functions for the cooker or heating appliance.

* * * * *